United States Patent [19]

Woytiuk

[11] 3,980,807

[45] Sept. 14, 1976

[54] POLYURETHANE JACKETING OF METAL SHEATHED CABLE

[75] Inventor: Leo Victor Woytiuk, Point-Claire, Canada

[73] Assignee: Northern Electric Company Limited, Montreal, Canada

[22] Filed: Mar. 17, 1975

[21] Appl. No.: 559,175

[52] U.S. Cl. ..... 174/107; 174/102 D

[51] Int. Cl.[2] ..... H01B 7/18

[58] Field of Search ..... 174/102 R, 102 D, 106 R, 174/106 D, 107, 110 PM, 110 SR, 120 R, 120 SR, 121 SR; 138/121, 123, 124, 125, 129, 130, 177

[56] References Cited

UNITED STATES PATENTS

| | | | |
|---|---|---|---|
| 2,492,568 | 12/1949 | Gillis | 174/102 D |
| 3,007,203 | 11/1961 | Ammons | 174/110 F |
| 3,479,621 | 11/1969 | Martin | 174/102 D |
| 3,484,539 | 12/1969 | Glander et al. | 174/107 |
| 3,745,232 | 7/1973 | Johnson et al. | 174/102 D X |
| 3,857,996 | 12/1974 | Hansen et al. | 174/120 SR |
| 3,894,172 | 7/1975 | Jachimowicz | 174/110 F X |

FOREIGN PATENTS OR APPLICATIONS

| | | | |
|---|---|---|---|
| 2,120,152 | 5/1972 | Germany | 174/120 SR |

*Primary Examiner*—Arthur T. Grimley

[57] ABSTRACT

A method of jacketing an electric cable having a corrugated metal sheath, in which the sheath is cleaned, a coating of thermosetting, castable polyurethane is applied to fill the troughs in the corrugations, a fabric is wrapped onto the coated sheath and coated with the same polyurethane, and thermoplastic polyurethane is extruded onto the cable to form a jacket. The coatings of the polyurethane serve as an adhesive for bonding the jacket to the metal sheath. A cable produced by this method comprises a layer of fabric circumscribing the corrugated metal sheath and a jacket of thermoplastic polyurethane overlying the sheath, the fabric being embedded in a layer of thermosetting, castable polyurethane bonding the jacket to the sheath.

3 Claims, 4 Drawing Figures

POLYURETHANE JACKETING OF METAL SHEATHED CABLE

This invention relates to the jacketing of corrugated sheath electric cables.

Larger diameter cables use a corrugated metal sheathing for flexibility. An example of this type of cable is shown in U.S. Pat. No. 2,589,700 issued Mar. 18, 1952 to Western Electric Company assignee of Harold G. Johnstone and is known as a Stalpeth Sheath. Polyurethane is used to jacket these (and other) electric cables because of its ability to seal the cable against the penetration of moisture. However, the usual adhesives do not readily bond polyurethane to the corrugated steel sheathing of such cables, with the result that a thin polyurethane jacket applied to such a cable tends to balloon under gas pressure when it is not air tight.

It is an object of the present invention to provide a method of forming a reinforced polyurethane jacket on an electric cable having a corrugated metal sheath.

It is another object of the invention to provide an electric cable, having a corrugated metal sheath, with an outer jacket of polyurethane bonded to the sheath and reinforced to inhibit ballooning.

The invention in its broadest sence consists of an electric cable having a core and a corrugated metal sheath, a layer of fabric circumscribing the sheath and embedded in thermosetting polyurethane resin, and a jacket of thermoplastic polyurethane resin circumscribing the sheath and overlaying the layer of fabric, and thermosetting polyurethane bonding the jacket to the sheath.

An example embodiment of the invention is shown in the accompanying drawings in which.

Figure 1:
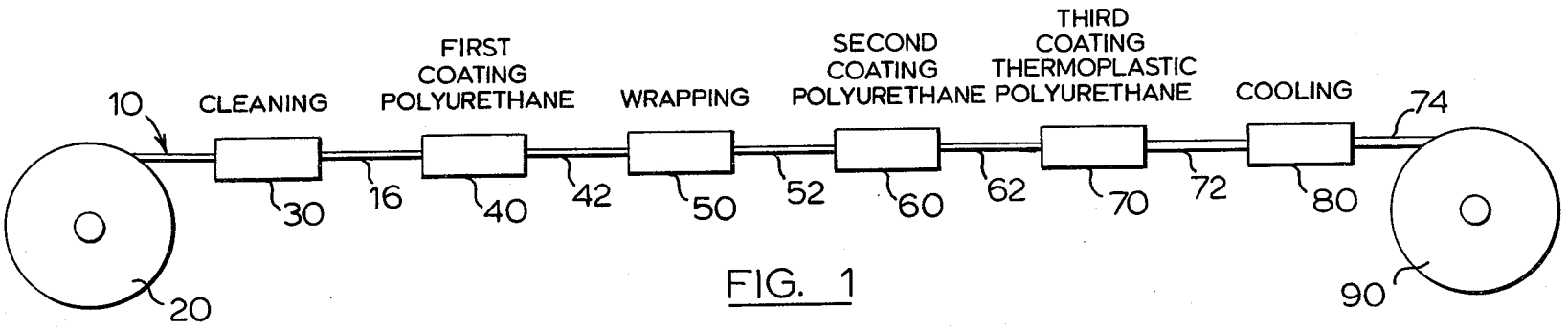
FIG. 1 is a schematic flow diagram for producing a polyurethane jacketed, corrugated metal sheath electric cable.

In the method of the invention as shown in FIG. 1 of the drawings a metal sheathed cable 10 to be jacketed with polyurethane is unwound from a give-up reel 20 and passed through a series of stations each carrying out a step in the method. At the first station 30 the outer surface of the sheath of cable 10 is cleaned by applying a suitable solvent to remove any oil or other substances which would prevent adhesion of the polyurethane jacket to be applied in subsequent steps. Preferably a bath of trichloroethylene vapor degreaser is used to clean the metal sheath of cable 10. After pasing from station 30, cable 10 enters a second station 40 where a first coating 42 of a two-component castable polyurethane resin is applied to the sheath of the cable to fill the troughs of the corrugations in the sheath. For this purpose a combination of an oil based polyol and isocyanate may be used such as C encapsulant sold by Devcon Corporation. Passing to a third station 50, a fabric is laid on the sheath of cable 10 to form a circumscribing mat 52. Preferably the fabric of mat 52 is non-woven such as a polyester sold by DuPont Corporation under the trade mark "Reemy" but the fabric may be heat set stabilized nylon or polyester such as that sold by Lincoln Fabrics Limited, known as "Leno" fabric. In the next step of the method cable 10 passes through a fourth station 60 where a second coating 62 of the two-component castable polyurethane resin is applied to saturate mat 52. Finally, at a fifth station 70 a third coating 72 of thermoplastic polyurethane resin such as "Estane 58300" or "Estane 58304" supplied by B. F. Goodrich Co. is extruded over saturated mat 52 to form an outer jacket 74 which then passes through cooling water in a trough 80. The initial heat of the extruded thermoplastic polyurethane (say 400°F) accelerates cure of the adhesive compound in the first and second coatings of castable polyurethane. After jacketed cable 10 passes through trough 80 it is wound on a take-up reel 90 for storage delivery.

Figure 3:
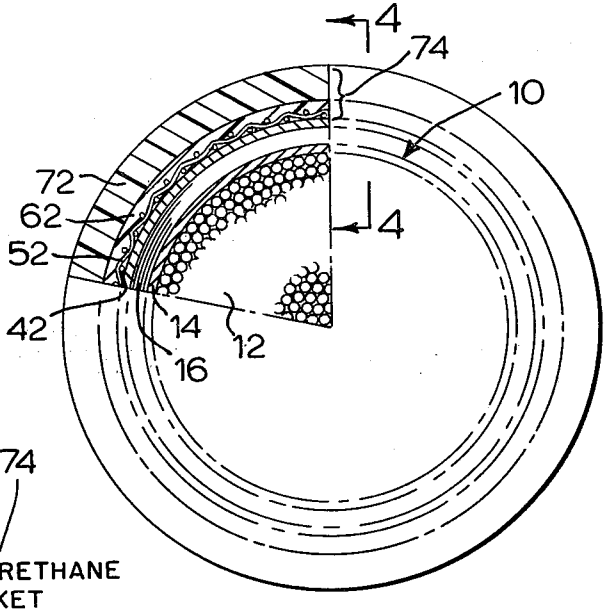
FIG. 3 is a segmental cross-sectional view taken along line 2—2 of FIG. 2.
Figure 2:
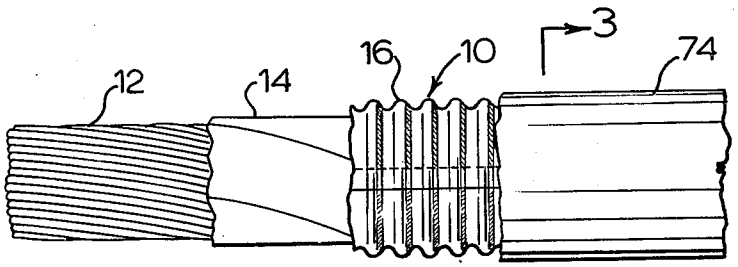
FIG. 2 is a side view, partly broken away, showing a cable jacketed according to the invention.
Figure 4:
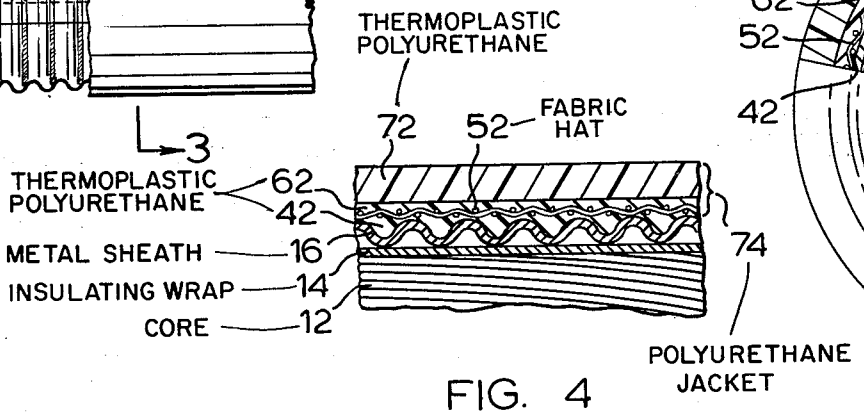
FIG. 4 is a cross-section taken along line 4—4 of FIG. 3.

Cable 10 produced by the method described above is shown in FIGS. 2 to 4 of the drawings and consists of a core 12 composed of a plurality of conductors, an insulating wrap 14 of paper or the like, and a corrugated metal sheath 16. In accordance with the invention outer jacket 74 of polyurethane overlies sheath 16 with fabric mat 52 circumscribing the sheath end embedded in the jacket. Third coating 72 of polyurethane abuts mat 52 which in turn abuts sheath 16; thus the thickness of the first and second coatings of the two-component polyurethane is approximately equal to the depth of the corrugations of the sheath plus the thickness of the mat.

It will be appreciated that a cable according to the invention provides a jacket 74 more effectively bonded to the sheath and reinforced by mat 52 to prevent ballooning should the sheath not be air tight. Also, the invention provides a jacket which has increased flexibility over a wide temperature range.

I claim:

1. In an electric cable having a core and a corrugated metal sheath, a layer of fabric circumscribing the sheath and embedded in thermosetting polyurethane resin, and a jacket of thermoplastic polyurethane resin circumscribing the sheath and overlaying the layer of fabric, and thermosetting polyurethane bonding the jacket to the sheath.

2. An electric cable as claimed in claim 1 in which the fabric is non-woven.

3. An electric cable as claimed in claim 1 in which the fabric is polyester.

* * * * *